US011694596B2

(12) United States Patent
Li et al.

(10) Patent No.: US 11,694,596 B2
(45) Date of Patent: Jul. 4, 2023

(54) DISPLAY DRIVING SYSTEM AND ELECTRONIC EQUIPMENT

(71) Applicant: TCL CHINA STAR OPTOELECTRONICS TECHNOLOGY CO., LTD., Guangdong (CN)

(72) Inventors: Wenfang Li, Guangdong (CN); Yuhua Chang, Guangdong (CN)

(73) Assignee: TCL CHINA STAR OPTOELECTRONICS TECHNOLOGY CO., LTD., Guangdong (CN)

( * ) Notice: Subject to any disclaimer, the term of this patent is extended or adjusted under 35 U.S.C. 154(b) by 317 days.

(21) Appl. No.: 16/972,891

(22) PCT Filed: Oct. 22, 2020

(86) PCT No.: PCT/CN2020/122665
§ 371 (c)(1),
(2) Date: Dec. 7, 2020

(87) PCT Pub. No.: WO2022/047914
PCT Pub. Date: Mar. 10, 2022

(65) Prior Publication Data

US 2022/0293032 A1 Sep. 15, 2022

(30) Foreign Application Priority Data

Sep. 2, 2020 (CN) ..... 202010910560.6

(51) Int. Cl.
*G09G 3/20* (2006.01)

(52) U.S. Cl.
CPC ..... *G09G 3/2092* (2013.01); *G09G 2310/08* (2013.01); *G09G 2330/021* (2013.01)

(58) Field of Classification Search
USPC ..... 345/204
See application file for complete search history.

(56) References Cited

U.S. PATENT DOCUMENTS

| | | | |
|---|---|---|---|
| 2002/0039153 | A1 | 4/2002 | Yoo |
| 2012/0062605 | A1 | 3/2012 | Aioanei |
| 2015/0331469 | A1 | 11/2015 | Ristic et al. |
| 2016/0275848 | A1 | 9/2016 | Zhang et al. |

(Continued)

FOREIGN PATENT DOCUMENTS

| | | | |
|---|---|---|---|
| CN | 200965669 | Y | 10/2007 |
| CN | 101802749 | A | 8/2010 |

(Continued)

*Primary Examiner* — Ifedayo B Iluyomade

(57) ABSTRACT

An electronic equipment and a display driving system are provided. The display driving system includes a power management circuit and a timing circuit electrically connected to the power management circuit. The power management circuit receives an input voltage and output a working voltage according to the input voltage. The timing circuit receives the working voltage and output a predetermined command to the power management circuit. The power management circuit is further configured to select a predetermined working mode according to the predetermined command such that the power management circuit works in the predetermined working mode.

16 Claims, 2 Drawing Sheets

(56) References Cited

U.S. PATENT DOCUMENTS

| | | | | |
|---|---|---|---|---|
| 2017/0083069 | A1 | 3/2017 | Dibene, II et al. | |
| 2021/0110751 | A1* | 4/2021 | Choi | G09G 3/3225 |

FOREIGN PATENT DOCUMENTS

| | | | | | |
|---|---|---|---|---|---|
| CN | 103135728 | A | | 6/2013 | |
| CN | 104731147 | A | | 6/2015 | |
| CN | 105050172 | A | | 11/2015 | |
| CN | 107948747 | A | | 4/2018 | |
| CN | 108198536 | A | | 6/2018 | |
| CN | 109448621 | A | | 3/2019 | |
| CN | 110675794 | A | | 1/2020 | |
| CN | 111105743 | A | | 5/2020 | |
| KR | 1020190126924 | | * | 4/2021 | G09G 3/20 |

* cited by examiner

DISPLAY DRIVING SYSTEM AND ELECTRONIC EQUIPMENT

FIELD OF THE INVENTION

The present invention relates to a display technology, and more particularly, to a display driving system and an electronic equipment.

BACKGROUND

A display device often comprises a display panel and an external driving system. The external system normally comprises a control printed circuit board (PCB) and a system on chip (SOC). The control PCB has a timing controller and a power management IC (PMIC).

Conventionally, the ranges of the input voltage of the PMIC for different display devices are different. Therefore, a PMIC cannot be used in different display device. For example, the ranges of the input voltage for the TV display screen and the business display screen are different. In other words, two PMICs are required for the TV display screen and the business display screen. This increases the costs.

If the input voltage range of the conventional PMIC is directly adjusted to be larger, when the input voltage reduces in a shut-down process of a display screen having a larger input voltage, the PMIC still works and thus the power consumption of the chip increases.

SUMMARY

Technical Problem

One objective of an embodiment of the present invention is to provide a display driving system and an electronic equipment to solve the above-mentioned issue where a conventional power management circuit has a narrow input voltage range and cannot be used in multiple display modes.

Technical Solution

According to an embodiment of the present invention, a display driving system is disclosed. The display driving system comprises a power management circuit and a timing circuit. The power management is configured to receive an input voltage and output a working voltage according to the input voltage. The timing circuit is electrically connected to the power management circuit, and is configured to receive the working voltage and output a predetermined command to the power management circuit. The power management circuit is further configured to select a predetermined working mode according to the predetermined command such that the power management circuit works in the predetermined working mode.

Optionally, the power management circuit comprises a storage unit and a power management unit. The storage unit is configured to receive the predetermined command and transfers the predetermined command to the power management unit. The power management unit is configured to receive the input voltage and output the working voltage according to the input voltage and to select the predetermined working mode according to the predetermined command such that the power management circuit works in the predetermined working mode.

Optionally, the power management unit and the storage unit are both installed in the power management integrated circuit chip.

Optionally, the timing circuit is installed in a timing controller chip.

Optionally, the predetermined working mode comprise a TV display mode and a business display mode. The predetermined command is a TV display command and a business display command. When the power management circuit works in the TV display mode, the predetermined command is the TV display command. When the power management circuit works in the business display mode, the predetermined command is the business V display command.

Optionally, when the power management circuit works in the TV display mode, the power management mode is further configured to compare the input voltage with a first threshold voltage and to output a target voltage if the input voltage is higher than the first threshold voltage.

Optionally, when the power management circuit works in the TV display mode, the power management circuit is configured further to compare the input voltage with a second threshold voltage during a shut down operation and not to output a target voltage if the input voltage is lower than the second threshold voltage.

Optionally, when the power management circuit receives the input voltage, the power management circuit is further configured to compare the input voltage with a third threshold voltage and output the working voltage if the input voltage is higher than the third threshold voltage.

Optionally, when the power management circuit works in the business display mode, the power management circuit is further configured to compare the input voltage with a fourth threshold voltage during a shut down operation and is turned off if the input voltage is lower than the fourth threshold voltage.

According to an embodiment of the present invention, an electronic equipment is disclosed. The electronic equipment comprises a display driving system. The display driving system comprises a power management circuit and a timing circuit. The power management is configured to receive an input voltage and output a working voltage according to the input voltage. The timing circuit is electrically connected to the power management circuit, and is configured to receive the working voltage and output a predetermined command to the power management circuit. The power management circuit is further configured to select a predetermined working mode according to the predetermined command such that the power management circuit works in the predetermined working mode.

Optionally, the power management circuit comprises a storage unit and a power management unit. The storage unit is configured to receive the predetermined command and transfers the predetermined command to the power management unit. The power management unit is configured to receive the input voltage and output the working voltage according to the input voltage and to select the predetermined working mode according to the predetermined command such that the power management circuit works in the predetermined working mode.

Optionally, the power management unit and the storage unit are both installed in the power management integrated circuit chip.

Optionally, the timing circuit is installed in a timing controller chip.

Optionally, the predetermined working mode comprise a TV display mode and a business display mode. The predetermined command is a TV display command and a business display command. When the power management circuit works in the TV display mode, the predetermined command is the TV display command. When the power management circuit works in the business display mode, the predetermined command is the business V display command.

Optionally, when the power management circuit works in the TV display mode, the power management mode is further configured to compare the input voltage with a first threshold voltage and to output a target voltage if the input voltage is higher than the first threshold voltage.

Optionally, when the power management circuit works in the TV display mode, the power management circuit is configured further to compare the input voltage with a second threshold voltage during a shut down operation and not to output a target voltage if the input voltage is lower than the second threshold voltage.

Optionally, when the power management circuit receives the input voltage, the power management circuit is further configured to compare the input voltage with a third threshold voltage and output the working voltage if the input voltage is higher than the third threshold voltage.

Optionally, when the power management circuit works in the business display mode, the power management circuit is further configured to compare the input voltage with a fourth threshold voltage during a shut down operation and is turned off if the input voltage is lower than the fourth threshold voltage.

Advantageous Effects

The present invention provides a display driving system and an electronic equipment. The display driving system comprises a power management circuit and a timing circuit, the power management circuit is configured to receive an input voltage and output a working voltage to the timing circuit according to the input voltage. The timing circuit receive the working voltage and output a predetermined command to the power management circuit. The power management circuit could select a predetermined working mode according to the predetermined command such that the power management circuit works in the predetermined working mode. In this way, the range of input voltage of the power management circuit could be enlarged such that the display driving system could be used in different display modes.

BRIEF DESCRIPTION OF THE DRAWINGS

The accompanying figures to be used in the description of embodiments of the present disclosure or prior art will be described in brief to more clearly illustrate the technical solutions of the embodiments or the prior art. The accompanying figures described below are only part of the embodiments of the present disclosure, from which figures those skilled in the art can derive further figures without making any inventive efforts.

DETAILED DESCRIPTION OF PREFERRED EMBODIMENTS

Figure 1:
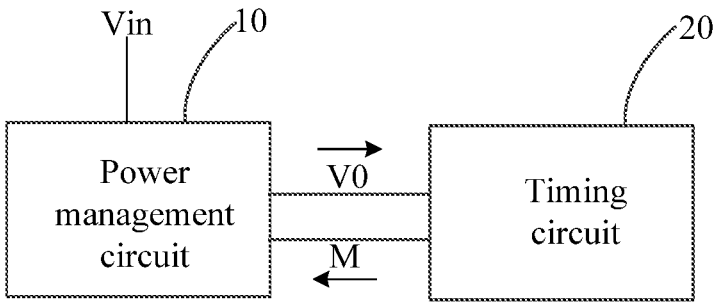
FIG. 1 is a diagram of a display driving system of a first structure according to an embodiment of the present invention.

Embodiments of the present application are illustrated in detail in the accompanying drawings, in which like or similar reference numerals refer to like or similar elements or elements having the same or similar functions throughout the specification. The embodiments described below with reference to the accompanying drawings are exemplary and are intended to be illustrative of the present application, and are not to be construed as limiting the scope of the present application.

Please refer to FIG. 1. FIG. 1 is a diagram of a display driving system of a first structure according to an embodiment of the present invention. As shown in FIG. 1, the display driving system comprises a power management circuit 10 and a timing circuit 20. The power management circuit 10 is configured to receive an input voltage Vin and output a working voltage V0 according to the input voltage Vin. The timing circuit 20 is electrically connected to the power management circuit 10 and is configured to receive the working voltage V0 and output a predetermined command M to the power management circuit 10. In this embodiment, the power management circuit 10 is further configured to select a predetermined working mode according to the predetermined command M such that the power management circuit 10 could work in the predetermined working mode.

The driving system of the display device could comprise a control PCB and a SOC (now shown). The power management circuit 10 and the timing circuit 20 could be installed on the control PCB. The input voltage Vin could be provided by the SOC to the power management circuit 10.

The values of the input voltage Vin and the working voltage V0 could be set according to the specifications of each of the components of the display device and thus are not limited here.

The power management circuit 10 could select one of the predetermined working modes such that the power management circuit 10 could be used in a display device working in different voltage ranges, such as the TV display screen and the business display screen. These are not limited here.

The timing circuit 20 sets the predetermined command M according to the required working mode of the display device. For the display device having the same voltage range, the timing circuit 20 outputs the same predetermined command M.

In this embodiment, the display driving system adds a logic relationship between the power management circuit 10 and the timing circuit 20 such that the timing circuit 20 outputs a predetermined command M to the power management circuit 10 after receiving the working voltage V0 from the power management circuit 10. The power management circuit 10 could select a predetermined working mode according to the predetermined command M such that the power management circuit 10 works in the predetermined working mode. In this way, the range of the input voltage of the power management circuit 10 could be broaden and used in different display modes.

Figure 2:
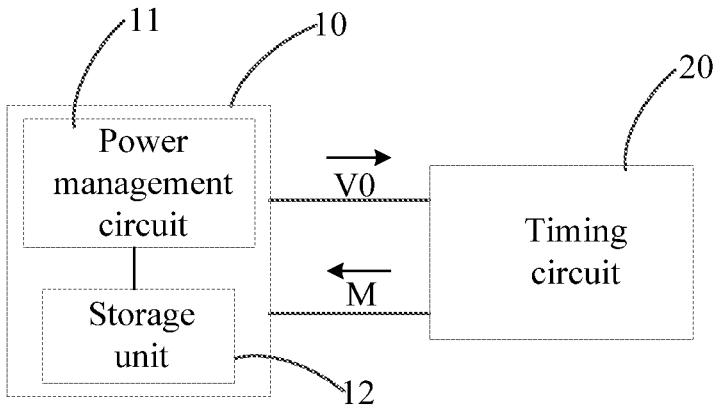
FIG. 2 is a diagram of a display driving system of a second structure according to an embodiment of the present invention.

Please refer to FIG. 2. FIG. 2 is a diagram of a display driving system of a second structure according to an embodiment of the present invention. As shown in FIG. 2, the power management circuit 10 comprises a storage unit 12 and a power management unit 11.

The storage unit 12 is configured to receive the predetermined command M and transfers the predetermined command M to the power management unit 11. The power management unit 11 is configured to receive the input voltage Vin and outputs the working voltage V0 according to the input voltage Vin. The power management unit 11 is further configured to receive the predetermined command M and select the predetermined working mode according to the predetermined command M such that the power management circuit 11 could work in the predetermined working mode.

The storage unit 12 is electrically connected to the power management unit 11. The storage unit 12 could store the predetermined command M. The power management unit 11 selects the corresponding predetermined working mode through reading the predetermined command M in the storage unit 12 and works in the predetermined working mode. When the display device is turned off, the predetermined command M stored in the storage unit 12 is automatically erased. In this way, the timing circuit 20 could write a new corresponding predetermined command M when the display device is turned on again.

Figure 3:
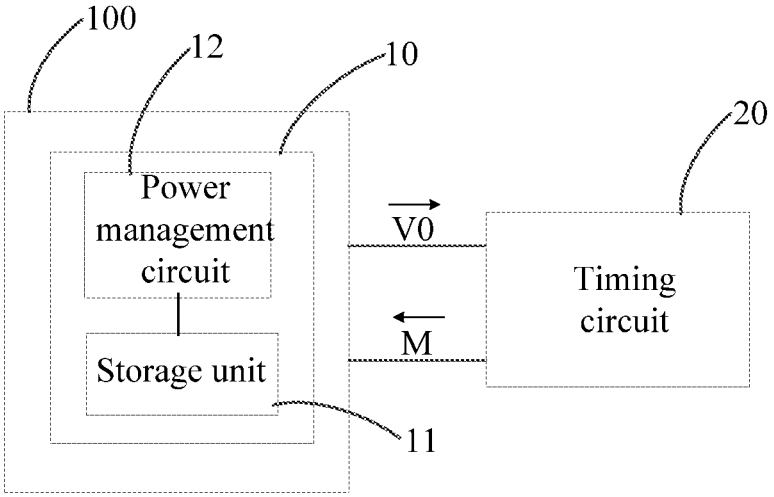
FIG. 3 is a diagram of a display driving system of a third structure according to an embodiment of the present invention.

In some embodiments, please refer to FIG. 3. FIG. 3 is a diagram of a display driving system of a third structure according to an embodiment of the present invention. As shown in FIG. 3, the display driving system comprises a power management integrated circuit chip 100. The power management unit 11 and the storage unit 12 are both installed in the power management integrated circuit chip 100.

The power management IC chip 100 is electrically connected to the timing circuit 20. The storage unit 12 could be a register installed in the power management IC chip 100. The timing circuit 20 could write the predetermined command M into the register through an I2C bus (The I2C bus is not clearly depicted in FIG. 3 and the connection line shown in FIG. 3 is only for illustration). Then, the power management unit 12 selects a corresponding working mode through reading the predetermined command M stored in the register such that the power management IC chip 100 works in the predetermined working mode.

When the display device is turned off, the predetermined command M stored in the register is erased. When the display device is turned on again, a new corresponding predetermined command M is written into the register.

Under a certain condition within a certain time period, the storage unit 12 could be indefinitely stored or erased. Therefore, the same power management IC chip 100 could be used in a display device having different display modes. For example, if a display device is out of order but the power management IC chip 100 could still normally work, then the power management IC chip 100 could be used in another display device. The working mode of the another display device could be the same as or different from the broken one. Therefore, the scope of application of the power management IC chip 100 is broader and the manufacturing difficulty of the power management IC chip 100 is reduced. Thus, the manufacturing cost of the power management IC chip 100 is reduced.

The storage unit 12 is not necessary to be installed in the power management IC chip 100. The storage unit 12 could be independently installed on the PCB as long as the power management IC chip 100 could read the predetermined command from the storage unit 12 and select the corresponding predetermined working mode accordingly. The present invention does not limit this.

The display driving system further comprises a timing controller chip. The timing circuit 20 is installed in the timing controller chip. In some embodiments, the timing circuit 20 could be a timing controller chip.

The power management IC chip 100 and the timing controller chip could be well-known devices and thus detailed illustrations are omitted here.

Figure 4:
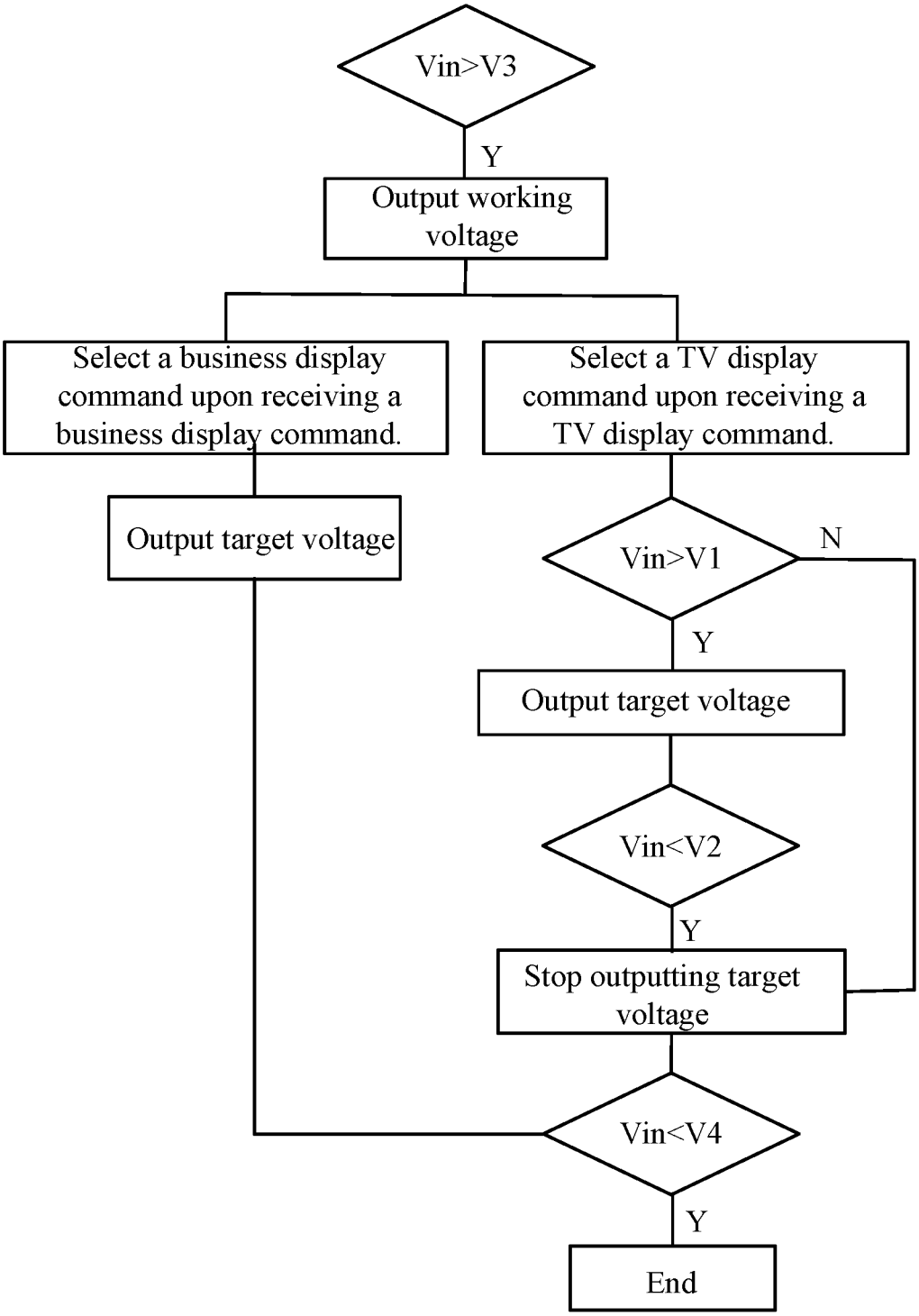
FIG. 4 is a flow chart of an operation of the power management circuit according to an embodiment of the present invention.

Please refer to FIG. 4. FIG. 4 is a flow chart of an operation of the power management circuit according to an embodiment of the present invention. In this embodiment, the predetermined command M comprises a business display command and a TV display command. Correspondingly, the predetermined working mode comprises a business display mode and a TV display mode.

When the power management circuit 10 is working in the TV display mode, the predetermined command M is the TV display command. When the power management circuit 10 is working in the business display mode, the predetermined command M is the business display command.

The business display mode is often used in a business display device, such as a gaming display device or an outdoor big-size display device. The TV display mode is often used in a TV display device. For the TV display device and the business display device, the ranges of the input voltage Vin of the power management circuit 10 are different. In this embodiment, the range of input voltage Vin in the business display mode is 4V-5.5V and the range of input voltage Vin in the TV display mode is 8V-12V. However, these are examples, not limitations of the present invention.

Please refer to FIG. 4 again. When the power management circuit 10 receives the input voltage Vin, the power management circuit 10 is further configured to compare the input voltage Vin with the third threshold voltage V3 and output the working voltage V0 if the input voltage Vin is higher than the third threshold voltage V3.

The third threshold voltage V3 is set according to the ranges of the input voltage Vin in the TV display mode and the business display mode of the power management circuit 10. In this embodiment, the range of input voltage Vin in the business display mode is 4V-5.5V and the range of input voltage Vin in the TV display mode is 8V-12V. The third threshold voltage V3 is set as 4V. Furthermore, according to the working demand of the timing circuit 20, the working voltage V0 is set as 3.3V.

When the display device is turned on, if the input voltage Vin is normal, then the input voltage Vin is higher than the third threshold voltage V3. At this time, the power management circuit 10 is in a standby state and outputs the working voltage V0 to the timing circuit 20. After the timing circuit 20 receives the working voltage V0, the timing circuit 20 outputs the predetermined command M to the power management circuit 10 such that the power management circuit 10 selects a corresponding predetermined working mode. If the display device is abnormally turned on or the input voltage Vin is abnormal, the input voltage Vin may be lower than the working voltage V0. In this case, the power management circuit 10 will not enter the working state to protect the display device.

If the display device is the business display device, the predetermined command M outputted by the timing circuit 20 is the business display command. The power management circuit 10 selects the business display mode based on the business display command and works in the business display mode. If the display device is the TV display device, the predetermined command M outputted by the timing circuit 20 is the TV display command. The power management circuit 10 selects the TV display mode based on the TV display command and works in the TV display mode.

When the power management circuit 10 works in the business display mode, because the third threshold voltage V3 is within the range of the input voltage Vin in the business display mode and the input voltage Vin is higher than the third threshold voltage V3, the power management circuit 10 immediately responds and outputs a target voltage.

In this embodiment, the target voltage may include the high voltage signal, the low voltage signal, the data signal or other display signals required for the business display device. Further details are omitted here. The response time of the power management circuit 10 is 1 ms-5 ms.

In addition, when the display device is being shut down, the input voltage Vin drops. The power management circuit 10 is further configured to compare the input voltage Vin with a fourth threshold voltage V4 during a shut down operation and is turned off if the input voltage Vin is lower than the fourth threshold voltage V4.

In this embodiment, the fourth threshold voltage V4 could be set according the actual requirement of the power management circuit 10 in the business display mode. In this embodiment, the fourth threshold voltage V4 is set as 3.5V. However, this is not a limitation of the present invention. It could be understood that the power management circuit 10 cannot be in a stable working condition when the input voltage Vin is lower than 3.5V in the business display mode. Therefore, the power management circuit 10 is turned off to prevent the display device from abnormally working.

In some embodiments, when the power management circuit 10 works in the TV display mode, the power management circuit 10 is further configured to compare the input voltage Vin with a first threshold voltage V1 and to output a target voltage if the input voltage Vin is higher than the first threshold voltage V1. In addition, the power management circuit 10 does not output the target voltage if the input voltage Vin is lower than the first threshold voltage V1.

Here, the target voltage may include the high voltage signal, the low voltage signal, the data signal or other display signals required for the business display device. Further details are omitted here.

The value of the first threshold voltage V1 could be set as 7.5V. It could be understood that the range of the input voltage Vin in the TV display mode is 8V-12V. However, the power management circuit 10 may work stably as long as the input voltage exceeds 7.5V. Therefore, the first threshold voltage V1 is reasonably set and is compared with the input voltage Vin to determine the time when the power management circuit 10 could output the correct target voltage. This could broaden the range of the working voltage and raises the response speed of the power management circuit 10.

When the display device is being shut down, the input voltage Vin drops. The power management circuit Vin compares the input voltage Vin with a second threshold voltage V2 and not to output a target voltage if the input voltage Vin is lower than the second threshold voltage V2.

In this embodiment, the second threshold voltage V2 could be set according the actual requirement of the power management circuit 10 in the TV display mode. In this embodiment, the second threshold voltage V2 is set as 7V. However, this is not a limitation of the present invention. It could be understood that the power management circuit 10 cannot be in a stable working condition when the input voltage Vin is lower than 7V in the TV display mode. Therefore, the power management circuit 10 no longer outputs the target voltage to prevent the display device from abnormally working.

Because the power management circuit 10 further comprises the business display mode, the manufacturing difficulty of the power management circuit 10 is reduced in order to maintain the consistency. When the input voltage Vin is lower than 7V, the power management circuit 10 still outputs the working voltage V0. Correspondingly, the power management circuit 10 compares the input voltage Vin with the fourth threshold voltage V4 during the shut-down operation. When the input voltage Vin is lower than the fourth threshold voltage V4, the power management circuit 10 is turned off. Here, the fourth threshold voltage V4 is set based on the presumption that the power management circuit 10 works in the business display mode. Further details are omitted here.

In some embodiments, the power management circuit 10 could be set as being turned off during the shut-down operation without outputting the target voltage or the working voltage V0 if the input voltage Vin is lower than 7V in the TV display mode. In this way, the power management circuit 10 does not need to compare the input voltage Vin with the fourth threshold voltage V4 again such that the power consumption of the power management circuit 10 is reduced.

In the above embodiments, the predetermined display mode comprises the business display mode and the TV display mode. However, this is an example, not a limitation of the present invention.

According to an embodiment of the present invention, an electronic equipment is disclosed. The electronic equipment comprises the display driving system of any of the above-mentioned embodiments. Since the details of the display driving system is disclosed in the above, further illustration is omitted here. Furthermore, the electronic equipment could be a smart phone, a tablet, an electronic book reader, a smart watch, a camera, or a gamer. This is not a limitation of the present invention.

In contrast to the prior art, the present invention provides a display driving system and an electronic equipment. The display driving system comprises a power management circuit and a timing circuit, the power management circuit is configured to receive an input voltage and output a working voltage to the timing circuit according to the input voltage. The timing circuit receive the working voltage and output a predetermined command to the power management circuit. The power management circuit could select a predetermined working mode according to the predetermined command such that the power management circuit works in the predetermined working mode. In this way, the range of input voltage of the power management circuit could be enlarged such that the display driving system could be used in different display modes.

Above are embodiments of the present invention, which does not limit the scope of the present invention. Any modifications, equivalent replacements or improvements within the spirit and principles of the embodiment described above should be covered by the protected scope of the invention.

What is claimed is:

1. A display driving system, comprising:

a power management circuit, configured to receive an input voltage and output a working voltage according to the input voltage; and a timing circuit, electrically connected to the power management circuit, configured to receive the working voltage and output a predetermined command to the power management circuit;

wherein the power management circuit comprises:

a storage unit, configured to receive the predetermined command; and a power management unit, configured to receive the input voltage and output the working voltage according to the input voltage and to select a predetermined working mode according to the predetermined command such that the power management circuit works in the predetermined working mode.

2. The display driving system of claim 1, wherein the power management unit and the storage unit are both installed in the power management integrated circuit chip.

3. The display driving system of claim 1, wherein the timing circuit is installed in a timing controller chip.

4. The display driving system of claim 1, wherein the predetermined working mode comprise a TV display mode and a business display mode; and the predetermined command is a TV display command and a business display command; and wherein when the power management circuit works in the TV display mode, the predetermined command is the TV display command; and when the power management circuit works in the business display mode, the predetermined command is the business V display command.

5. The display driving system of claim 4, wherein when the power management circuit works in the TV display mode, the power management mode is further configured to compare the input voltage with a first threshold voltage and to output a target voltage if the input voltage is higher than the first threshold voltage.

6. The display driving system of claim 4, wherein when the power management circuit works in the TV display mode, the power management circuit is configured further to compare the input voltage with a second threshold voltage during a shut down operation and not to output a target voltage if the input voltage is lower than the second threshold voltage.

7. The display driving system of claim 4, wherein when the power management circuit receives the input voltage, the power management circuit is further configured to compare the input voltage with a third threshold voltage and output the working voltage if the input voltage is higher than the third threshold voltage.

8. The display driving system of claim 4, wherein when the power management circuit works in the business display mode, the power management circuit is further configured to compare the input voltage with a fourth threshold voltage during a shut down operation and is turned off if the input voltage is lower than the fourth threshold voltage.

9. An electronic equipment, comprising a display driving system, the display driving system comprising:

a power management circuit, configured to receive an input voltage and output a working voltage according to the input voltage; and a timing circuit, electrically connected to the power management circuit, configured to receive the working voltage and output a predetermined command to the power management circuit;

wherein the power management circuit comprises:

a storage unit, configured to receive the predetermined command; and a power management unit, configured to receive the input voltage and output the working voltage according to the input voltage and to select a predetermined working mode according to the predetermined command such that the power management circuit works in the predetermined working mode.

10. The electronic equipment of claim 9, wherein the power management unit and the storage unit are both installed in the power management integrated circuit chip.

11. The electronic equipment of claim 9, wherein the timing circuit is installed in a timing controller chip.

12. The electronic equipment of claim 9, wherein the predetermined working mode comprise a TV display mode and a business display mode; and the predetermined command is a TV display command and a business display command; and wherein when the power management circuit works in the TV display mode, the predetermined command is the TV display command; and when the power management circuit works in the business display mode, the predetermined command is the business V display command.

13. The electronic equipment of claim 12, wherein when the power management circuit works in the TV display mode, the power management mode is further configured to compare the input voltage with a first threshold voltage and to output a target voltage if the input voltage is higher than the first threshold voltage.

14. The electronic equipment of claim 12, wherein when the power management circuit works in the TV display mode, the power management circuit is configured further to compare the input voltage with a second threshold voltage during a shut down operation and not to output a target voltage if the input voltage is lower than the second threshold voltage.

15. The electronic equipment of claim 12, wherein when the power management circuit receives the input voltage, the power management circuit is further configured to compare the input voltage with a third threshold voltage and output the working voltage if the input voltage is higher than the third threshold voltage.

16. The electronic equipment of claim 12, wherein when the power management circuit works in the business display mode, the power management circuit is further configured to compare the input voltage with a fourth threshold voltage during a shut down operation and is turned off if the input voltage is lower than the fourth threshold voltage.

* * * * *